US007520915B2

(12) United States Patent
Yoon et al.

(10) Patent No.: US 7,520,915 B2
(45) Date of Patent: Apr. 21, 2009

(54) METHOD OF PREPARING NANO SCALE NICKEL POWDERS BY WET REDUCING PROCESS

(75) Inventors: Seon-mi Yoon, Gyeonggi-do (KR); Jae-young Choi, Gyeonggi-do (KR); Yong-kyun Lee, Gyeonggi-do (KR); Yulia Potapova, Gyeonggi-do (KR)

(73) Assignee: Samsung Electro-mechanics Co., Ltd., Suwon-si, Gyeonggi-do (KR)

( * ) Notice: Subject to any disclaimer, the term of this patent is extended or adjusted under 35 U.S.C. 154(b) by 392 days.

(21) Appl. No.: 11/133,171

(22) Filed: May 20, 2005

(65) Prior Publication Data

US 2006/0042416 A1 Mar. 2, 2006

(30) Foreign Application Priority Data

Aug. 26, 2004 (KR) ..... 10-2004-0067528

(51) Int. Cl.

| | |
|---|---|
| ***B22F 1/00*** | (2006.01) |
| ***B22F 9/00*** | (2006.01) |
| ***C21B 15/04*** | (2006.01) |
| ***C22B 5/20*** | (2006.01) |
| ***C22C 1/04*** | (2006.01) |

(52) U.S. Cl. ..... 75/374; 977/777

(58) Field of Classification Search ..... 75/365, 75/348, 330, 343, 362, 363, 364, 369, 370, 75/371, 374, 392, 414, 416, 419, 420, 425, 75/430, 585, 628, 710, 711, 721

See application file for complete search history.

(56) References Cited

U.S. PATENT DOCUMENTS

| | | | |
|---|---|---|---|
| 3,850,612 | A | 11/1974 | Montino et al. |
| 4,539,041 | A | 9/1985 | Figlarz et al. |
| 5,759,230 | A | 6/1998 | Chow et al. |
| 6,120,576 | A | 9/2000 | Toshima et al. |
| 6,262,129 | B1 | 7/2001 | Murray et al. |
| 6,974,492 | B2 | 12/2005 | Harutyunyan et al. |
| 7,182,801 | B2 | 2/2007 | Kim et al. |

(Continued)

FOREIGN PATENT DOCUMENTS

| | | | |
|---|---|---|---|
| CN | 1539581 | A | 10/2004 |

(Continued)

OTHER PUBLICATIONS

*D.A. Papaconstantopoulos et al., "Ferromagnetism in Hexagonal-Close-Packed Elements", Physical Review B, Feb. 1, 1989, vol. 39 No. 4, pp. 2526-2528.

(Continued)

*Primary Examiner*—Roy King
*Assistant Examiner*—Vanessa Velasquez
(74) *Attorney, Agent, or Firm*—Buchanan Ingersoll & Rooney PC

(57) ABSTRACT

There is provided a method of preparing nano scale nickel powders by wet reducing process. An embodiment of the method of preparing nickel powders comprises preparing the first solution formed by mixing water and a base, preparing the second solution formed by mixing a polyol and a nickel compound, preparing a mixture by mixing the first solution and the second solution, heating the mixture, and separating the nickel powders generated during heating.

13 Claims, 5 Drawing Sheets

U.S. PATENT DOCUMENTS

| | | | | |
|---|---|---|---|---|
| 7,211,126 | B2 * | 5/2007 | Kim et al. | 75/348 |
| 7,238,221 | B2 * | 7/2007 | Kim et al. | 75/365 |
| 2004/0200318 | A1 * | 10/2004 | Kim et al. | 75/252 |
| 2004/0200319 | A1 | 10/2004 | Kim et al. | |
| 2006/0090601 | A1 | 5/2006 | Goia et al. | |

FOREIGN PATENT DOCUMENTS

| | | | |
|---|---|---|---|
| DE | 3513119 | | 10/1986 |
| DE | 3513132 | | 10/1986 |
| KR | 2002-094069 | A | 12/2002 |
| KR | 10-2004-0087498 | A | 10/2004 |

OTHER PUBLICATIONS

Giovanni Carturan et al., "Hexagonal Close Packed Nickel Powder: Synthesis, Structural Characterization and Thermal Behavior", Material Letters, North Holland Publishing Company, Amsterdam, NL, vol. 7, No. 1.2, Aug. 1988.

D.A. Papaconstantopoulos et al., "Ferromagnetism in Hexagonal-Close-Packed Elements", Physical Review B, 1989, pp. 2526-2528, vol. 39, No. 4.

* cited by examiner

METHOD OF PREPARING NANO SCALE NICKEL POWDERS BY WET REDUCING PROCESS

CROSS-REFERENCE TO RELATED APPLICATION

This application claims the priority of Korean Patent Application No. 10-2004-0067528, filed on Aug. 26, 2004, in the Korean Intellectual Property Office, the disclosure of which is incorporated herein in its entirety by reference.

BACKGROUND OF THE INVENTION

1. Field of the Invention

The present invention relates to a method of preparing nano scale nickel powders by wet reducing process, and more particularly, a method of preparing nickel powders having minute and uniform particle sizes with a low production cost and high productivity.

2. Description of the Related Art

Nickel powders can be used as an inner electrode material of MLCC (multi layer ceramic capacitor) and an inner electrode material or a wiring material of other electric apparatuses.

The MLCC is an electrical apparatus transiently storing charges. Such MLCC has a structure that has many ceramic dielectric layer and flat electrode layers laminated on the ceramic dielectric layer.

The MLCC having such a structure is widely used in electronic devices, such as a computer and a mobile communication device, since it can obtain high capacitance with only a small volume.

Recently, there is a tendency to replace palladium (Pd) which was used as an electrode material of MLCC with nickel (Ni), which is inexpensive, to lower the cost of the MLCC. Thus, the inner electrode layer of the MLCC is formed with an electrode paste, which comprises nickel powders, by screen-printing.

To minimize the size of the MLCC and increase capacitance, the inner electrode layers having a thin thickness, i.e., a thickness less than 0.5 μm must be formed, and the techniques of preparing the electrode paste therefore are required. Further, in order to prepare a paste to form a thin electrode layer, nickel powders that are nano-scale and good in dispersity are required.

Research on the preparation of nano-scale nickel powders has been performed for a long time. The preparation method thereof includes a gas-state method and a liquid-state method.

The gas-state method is widely used since the shape of nickel powders, and impurities are relatively easily controllable. However, the method has disadvantages in the minimization of particles and the mass production. Meanwhile, the liquid-state method has advantages in that it is useful in mass production, the initial investment cost is low, and the process cost is low.

The representative example of the liquid-state method is a method of preparing a metal powder using a polyol. The method is described in U.S. Pat. No. 4,539,041.

U.S. Pat. No. 4,539,041 proposes a method of preparing a metal powder comprising dispersing a metal element, such as gold, platinum, silver, nickel, etc., in the form of a hydroxide, an oxide or a salt, into a liquid-state polyol reducing agent to prepare a mixture, and heating the mixture.

Experimentally, it was found that the pH range of the mixture, in which the metal compound is most easily reduced by a polyol, is about 9 to 11.

Thus, in the method of preparing nickel powders according to the prior art polyol method, an inorganic base, such as sodium hydroxide (NaOH), potassium hydroxide (KOH), etc. was added to the mixture of a polyol and a nickel compound to maximize the reduction effect of the polyol, and the polyol was used as a solvent for the inorganic base. That is, the major function of the inorganic base is to control the pH of the mixture to a proper level.

However, since a polyol is expensive and its solubility is low, when the polyol was used as a solvent for the inorganic base, it contributed to the rise in the cost of preparing nickel powders.

Further, since the method of preparing nickel powders according to the prior art polyol method has problems of low yield, low degree of spheres and large particle size due to the non-uniform distribution of particle size, an improvement in the method is desired.

Accordingly, a method of preparing nickel powders having minute and uniform particle sizes with a low production cost and high productivity is desired.

SUMMARY OF THE INVENTION

The present invention desirably provides a method of preparing nickel powders having minute and uniform particle sizes with a low production cost and high productivity.

According to an aspect of the present invention, there is provided a method of preparing nickel powders characterized in that the method comprises preparing a first solution formed by mixing water and a base, preparing a second solution formed by mixing a polyol and a nickel compound, preparing a mixture by mixing the first solution and the second solution, heating the mixture, and separating the nickel powders generated during heating.

BRIEF DESCRIPTION OF SEVERAL VIEWS OF DRAWINGS

The above and other features and advantages of the present invention will become more apparent by describing in detail exemplary embodiments thereof with reference to the attached drawings in which.

DETAILED DESCRIPTION OF THE INVENTION

Hereinafter, exemplary embodiments of a method of preparing nickel powders according to the present invention will be described in more detail with reference to attached drawing.

Figure 1:
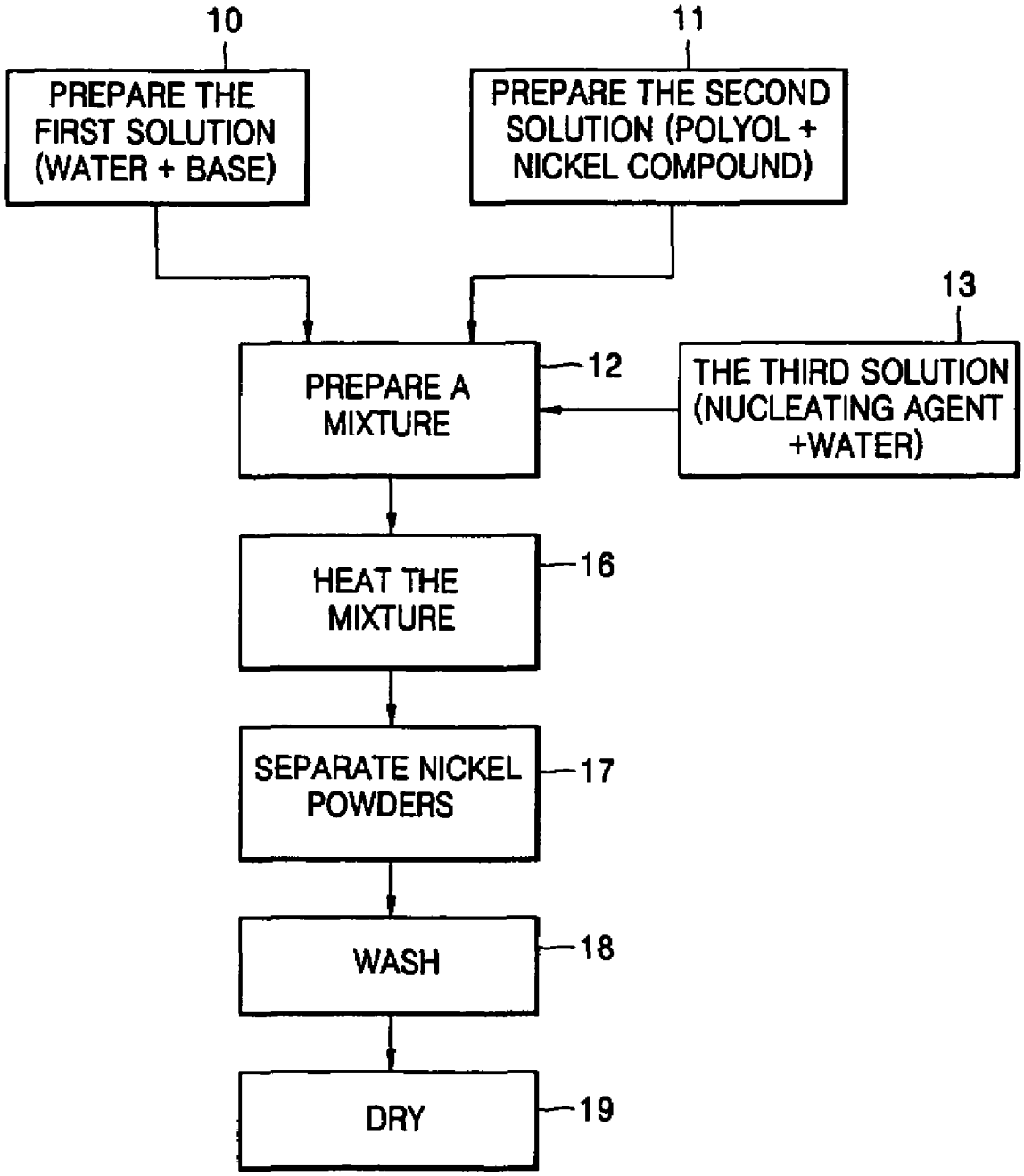
FIG. 1 is a process flowchart illustrating a method of preparing nickel powders according to an embodiment of the present invention.

FIG. 1 is a process flowchart illustrating a method of preparing nickel powders according to an embodiment of the present invention.

Firstly, water and a base may be mixed to prepare the first solution (10), and a polyol and a nickel compound may be mixed to prepare the second solution (11). Here, water can be distilled water. Then, the first solution and the second solution may be mixed to prepare a mixture (12).

Water may be used as a solvent for a base in the present invention. This can be compared to the prior art in which a polyol was used as a solvent for a base. Although a polyol functions as a solvent for a base, it is expensive and thus the cost of preparing nickel powders can be increased.

Generally, in the prior art polyol method, since a polyol acts as both solvent and reducing agent, adding water is excluded. The reason is because water can disturb the reduction reaction from a nickel compound to a metal nickel since water is an oxidizing agent.

However, in the present invention, water may be used as a solvent for a base in the initial time of the reduction reaction, and water in the mixture during heating can be completely evaporated and thus removed, during the reduction reaction from the nickel compound to metal nickel.

According to an embodiment of the method of preparing nickel powders of the present invention, the cost of preparing nickel powders can be reduced by using water instead of an expensive polyol as a solvent for a base.

In another aspect, when the polyol that was used as a solvent for a base in the past is further added as a solvent for a nickel compound, the nickel compound can be further dissolved and the production of nickel powders can be increased.

Further, in the prior art, a base and a nucleating agent were added to the mixture to act as a reaction controller to control the size of nickel particles reduced from the nickel compound.

According to the present invention, water, along with a base and a nucleating agent, can also act as a reaction controller to control the size of nickel particles reduced from the nickel compound, and influences to the speed of reduction reaction from the nickel compound to the metal nickel.

Accordingly, the expensive nucleating agent can be used in small amounts and the cost of preparing nickel powders can be reduced by using cheap water as a reaction controller.

The nickel powders prepared according to the present invention can have minute and uniform particle sizes since water functions both as a solvent for a base and as a reaction controller to minimize the sizes of the nickel particles during the reaction.

According to another embodiment of the present invention, a polyol can be further mixed to the first solution. The further mixed polyol, along with water, can also function as a solvent for a base. However, water can function both as a solvent for a base and as a reaction controller.

In order that water functions both as a solvent for a base and as a reaction controller, the amount of water in the mixture can be more than about 0.025 times the amount of the polyol in the mixture. The amount of water in the mixture can be about 0.025 to about 2 times the amount of the polyol in the mixture. The amount of water in the mixture can be about 0.025 to about 0.5 times the amount of the polyol in the mixture.

The base can comprise both inorganic base and organic base, which can be used alone or in combination. Thus, an inorganic base and water can be mixed to prepare the first solution, an organic base and water can also be mixed to prepare the first solution, and an inorganic base, an organic base and water can also be mixed to prepare the first solution.

The inorganic base may include alkali metal hydroxides, such as NaOH, KOH, etc., which can be used alone or in combination.

The organic base includes tetramethylammonium hydroxide (TMAH), tetraethylammonium hydroxide (TEAH), tetrabutylammonium hydroxide (TBAH), tetrapropylammonium hydroxide (TPAH), benzyltrimethylammonium hydroxide, dimethyldiethylammonium hydroxide, ethyltrimethylammonium hydroxide, tetrabutyl phosphonium hydroxide, trimethylamine (TMA), diethylamine (DEA), ethanolamine, etc., which can be used alone or in combination.

The impurities of alkali metals, such as a sodium, a potassium, etc., can be prevented from being incorporated into the nickel powders by using the organic bases instead of the inorganic bases, such as NaOH, KOH, etc. Also, a mixed base containing the organic base and the inorganic base in proper ratio can be used.

By experimentation, it was found that the pH range, in which the nickel compound may be easily reduced by a polyol, is about 9 to about 11.

Accordingly, the concentration of the base mixed with water can be so controlled that the pH of the mixture will be about 9 to about 11, and more preferably about 10 to about 11.

The nickel compound includes nickel salts, such as nickel sulfate, nickel nitrate, nickel chloride, nickel bromide, nickel fluoride, nickel acetate, nickel acetylacetonate, nickel hydroxide, etc., and these can be used alone or in combination.

The polyol plays both roles as a solvent dissolving a nickel compound and as a reducing agent to reducing a nickel compound into a nickel metal.

The polyol is an alcohol compound having more than two hydroxyl groups. The example of the polyol used as a reducing agent is described in detail in U.S. Pat. No. 4,539,041.

The polyol includes an aliphatic glycol as a dihydric alcohol, or a corresponding glycol polyester, etc.

The aliphatic glycol includes alkylene glycols having $C_2$-$C_6$ backbones, such as an ethanediol, a propanediol, a butanediol, a pentanediol, a hexanediol, etc., and polyethylene glycols and polyalkylene glycols derived from such alkylene glycols, etc.

The aliphatic glycol also includes also a diethylene glycol, a triethylene glycol, and a dipropylene glycol, etc.

Also, the polyol includes a glycerol as a trihydric alcohol, etc.

The polyol is not limited to the polyol compounds described above, and these polyol compounds can be used alone or in combination.

More preferably, the polyol includes an ethylene glycol, a diethylene glycol, a triethylene glycol, a tetraethylene glycol, a 1,2-propanediol, a 1,3-propanediol, a dipropylene glycol, a 1,2-butanediol, a 1,3-butanediol, a 1,4-butanediol, and a 2,3-butanediol, etc., and these can be used alone or in combination.

Preferably, the third solution prepared by mixing a nucleating agent and water can be further mixed to the mixture (13). The nucleating agent plays a role in promoting the nucleation of the nickel reduced from the nickel compound in the mixture, and accordingly, a number of nickel particles can be grown with a small and uniform particle size.

The nucleating agent includes $K_2PtCl_4$, $H_2PtCl_6$, $PdCl_2$ and $AgNO_3$, etc., and these can be used alone or in combination.

According to the method of preparing nickel powders of the present invention, the amount of the nucleating agent introduced into the mixture can be reduced by using water as a solvent for a base. Accordingly, the cost of preparing nickel powders can be reduced by decreasing the amount of the expensive nucleating agent.

According to another embodiment of the present invention, only the nucleating agent instead of the third solution can be further mixed to the mixture. According to still another embodiment of the present invention, the fourth solution prepared by mixing the nucleating agent and the polyol, instead of the third solution, can be further mixed to the mixture. According to still yet another embodiment of the present invention, the fifth solution prepared by mixing the nucleating agent, water and the polyol, instead of the third solution, can be further mixed to the mixture.

Such modification can be easily understood and deduced from the above-mentioned embodiments.

The mixture prepared by mixing the first solution, and the second solution. The third solution may placed in the reaction vessel and heated at a predetermined temperature for a specific time (16). The reduction reaction from a nickel compound to a metal nickel is promoted by heating.

The heating of the mixture can be performed at about 25° C. to 350° C. for about 2 to about 24 hours.

The maximum heating temperature of the mixture depends on the type of the polyol contained in the mixture, and can be a temperature below about 5° C. to about 20° C. or so than the boiling point of the polyol contained in the mixture. The reason is because the polyol is not only a reducing agent but also a solvent for a base and a nickel compound, and accordingly, the polyol must maintain the liquid state during heating (16).

The first reaction in which a nickel compound may be converted to a nickel hydroxide, and the second reaction in which the nickel hydroxide may be reduced to a metal nickel can be occurred separately during heating. Further, the first reaction and the second reaction can be occurred continuously almost at the same time.

Much nickel hydroxide can be generated in the first reaction. When much nickel hydroxide is generated, the particle size of the nickel powders generated in the second reaction can become minute and uniform.

Water in the mixture in the present invention can promote the generation of the nickel hydroxide in the first reaction. The reason is because a base reacts with water to provide more hydroxide ions, and increased hydroxide ions are able to promote the generation of the nickel hydroxide.

Water in the mixture influences to the growth rate of the nickel particles in the reduction reaction, and acts as a reaction controller making the size of the nickel particles minute. Further, water acts only in the initial time of the reduction reaction, and thereafter, water can be completely evaporated and thus removed, during the reaction.

The nickel hydroxide can be generated as much as possible in the first reaction. However, the longer heating time at about 25° C. to about 160° C., the more stable nickel hydroxide compound than the nickel compound can be formed. The reduction reaction from the nickel hydroxide compound to metal nickel may not proceed easily.

Thus, the heating can be divided into the first heating in which the mixture may be heated at about 25° C. to about 160° C., and the second heating in which the mixture may be heated at about 160° C. to about 350° C. after the first heating. The first heating can be performed for a relatively short time compared to that of the second heating.

The first heating can be performed for about 0.5 to about 4 hours, and the second heating can be performed for about 2 to about 20 hours.

The reaction vessel can further comprise a condenser on its upper part. When the mixture is heated over the boiling point of the polyol, the condenser collects the evaporated polyol, and returns the collected polyol to the reactor.

Metal nickel reduced from the nickel compound may be generated through the heating 16, and then is grown to particles having sphere shape, thereby forming nickel powders.

The nickel powders are separated through a filter (17), the separated nickel powders are washed with distilled water (18) and heated at a desired temperature for predetermined time, and the nickel powders are dried (19).

The present invention will be described in greater detail with reference to the following examples. The following examples are for illustrative purposes and are not intended to limit the scope of the invention.

EXAMPLES

Example 1

TMAH/$H_2O$ 23 g of TMAH (tetramethylammonium hydroxide) and 336.5 g of distilled water were dissolved in 250 ml of diethylene glycol to prepare the first solution. 30 g of $Ni(CH_3COO)_2.4H_2O$ were dissolved in 250 ml of diethylene glycol to prepare the second solution. 0.0996 g of $K_2PtCl_4$ nucleating agent were dissolved in 2 ml of ethylene glycol to prepare the third solution. The first solution, the second solution and the third solution were placed into a reaction vessel and stirred.

The mixture contained in the reaction vessel was heated at 200° C. for 6 hours with a heating mantle equipped with a magnetic stirrer to generate nickel powders. The resulting nickel powders were filtered to separate, and then washed with distilled water. The resulting nickel powders were dried at 25° C. for 8 hours in a vacuum oven.

Example 1 is the same as Comparative example 2 except that 336.5 g of water were added in preparing the first solution.

Figure 2:
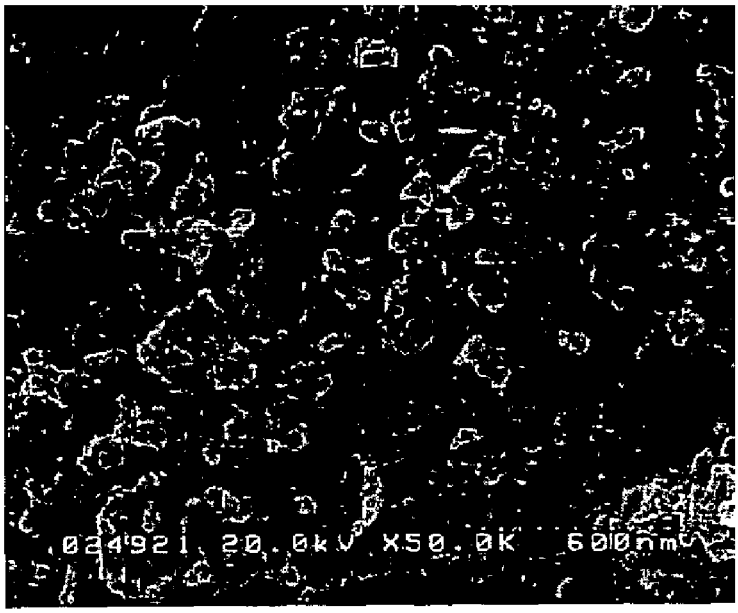
FIG. 2 is a SEM photograph of the nickel powders prepared according to Example 1 of the present invention.

The SEM photograph for the nickel powders of Example 1 was photographed, and the photograph is shown in FIG. 2. As shown in FIG. 2, the shape of the nickel powders of Example 1 was sphere and their particle size is about 80 nm. About 7 g of the powders were obtained.

Example 2

TMAH/$H_2O$ 68 g of TMAH were dissolved in 300 g of distilled water to prepare the first solution. 80 g of $Ni(CH_3COO)_2.4H_2O$ were dissolved in 500 ml of diethylene glycol to prepare the second solution. 0.0054 g of $AgNO_3$ nucleating agent were dissolved in 2 g of distilled water to prepare the third solution. The first solution, the second solution and the third solution were placed into a reaction vessel and stirred.

The mixture contained in the reaction vessel was heated at 200° C. for 6 hours with a heating mantle equipped with a magnetic stirrer to generate nickel powders. The resulting nickel powders were filtered to separate, and then washed with distilled water. The resulting nickel powders were dried at 25° C. for 8 hours in a vacuum oven.

Figure 3:
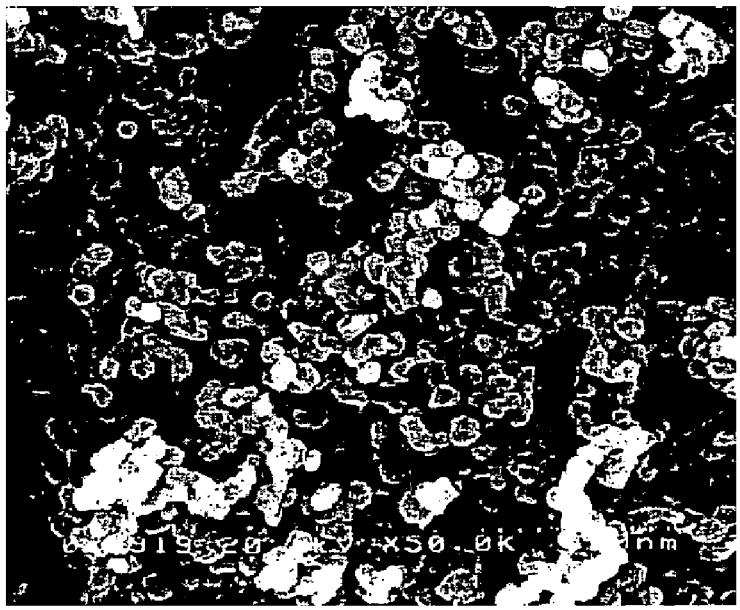
FIG. 3 is a SEM photograph of the nickel powders prepared according to Example 2 of the present invention.

The SEM photograph for the nickel powders of Example 2 was photographed, and the photograph is shown in FIG. 3. As shown in FIG. 3, the shape of the nickel powders of Example 2 was sphere and their particle size is about 80 nm. About 18.8 g of the powders were obtained.

Example 3

$NaOH/H_2O$ 20 g of NaOH were dissolved in 68 g of distilled water to prepare the first solution. 80 g of $Ni(CH_3COO)_2.4H_2O$ were dissolved in 500 ml of diethylene glycol to prepare the second solution. 0.0054 g of $AgNO_3$ nucleating agent were dissolved in 2 g of distilled water to prepare the third solution. The first solution, the second solution and the third solution were placed into a reaction vessel and stirred.

The mixture contained in the reaction vessel was heated at 200° C. for 6 hours with a heating mantle equipped with a magnetic stirrer to generate nickel powders. The resulting nickel powders were filtered to separate, and then washed with distilled water. The resulting nickel powders were dried at 25° C. for 8 hours in a vacuum oven.

Figure 4:
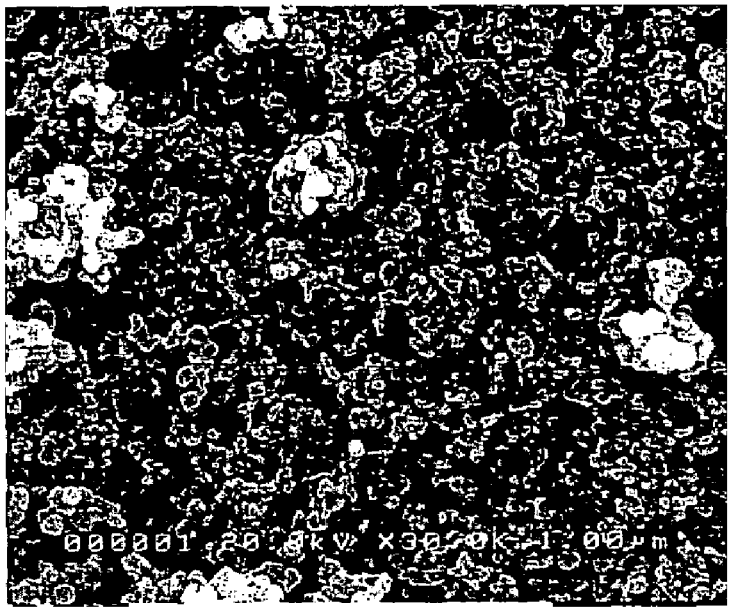
FIG. 4 is a SEM photograph of the nickel powders prepared according to Example 3 of the present invention.

The SEM photograph for the nickel powders of Example 3 was photographed, and the photograph is shown in FIG. 4. As shown in FIG. 4, the shape of the nickel powders of Example 3 was sphere and their particle size is about 80 nm. About 18.8 g of the powders were obtained.

Example 4

$TMAH+NaOH/H_2O$ 20 g of NaOH and 34 g of TMAH were dissolved in 150.4 g of distilled water to prepare the first solution. 80 g of $Ni(CH_3COO)_2.4H2O$ were dissolved in 500 ml of diethylene glycol to prepare the second solution. 0.0054 g of $AgNO_3$ nucleating agent were dissolved in 2 g of distilled water to prepare the third solution. The first solution, the second solution and the third solution were placed into a reaction vessel and stirred.

The mixture contained in the reaction vessel was heated at 200° C. for 6 hours with a heating mantle equipped with a magnetic stirrer to generate nickel powders. The resulting nickel powders were filtered to separate, and then washed with distilled water. The resulting nickel powders were dried at 25° C. for 8 hours in a vacuum oven.

Figure 5:
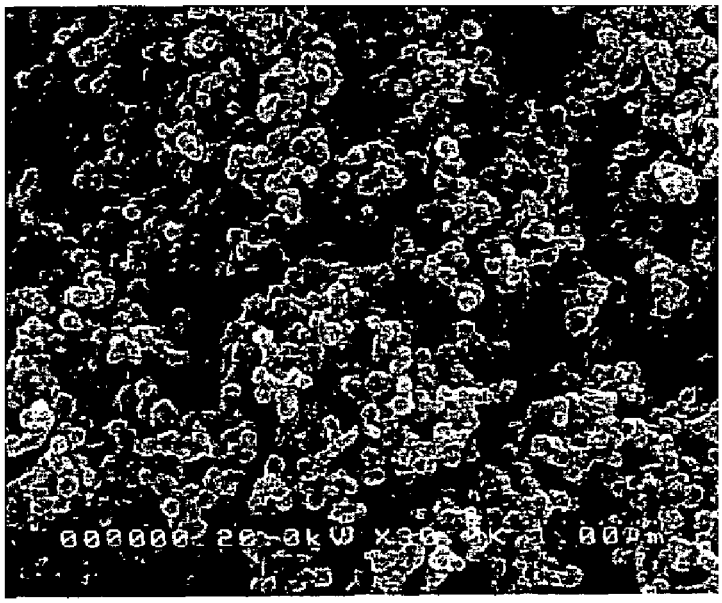
FIG. 5 is a SEM photograph of the nickel powders prepared according to Example 4 of the present invention.

The SEM photograph for the nickel powders of Example 4 was photographed, and the photograph is shown in FIG. 5. As shown in FIG. 5, the shape of the nickel powders of Example 4 was sphere and their particle size is about 80 nm. About 18.8 g of the powders were obtained.

COMPARATIVE EXAMPLES

Comparative Example 1

TMAH 23 g of TMAH were dissolved in 250 ml of ethylene glycol to prepare the first solution. 20 g of $Ni(CH_3COO)_2.4H_2O$ were dissolved in 250 ml of ethylene glycol to prepare the second solution. 0.0332 g of $K_2PtCl_4$ nucleating agent were dissolved in 2 ml of ethylene glycol to prepare the third solution. The first solution, the second solution and the third solution were placed into a reaction vessel and stirred.

The mixture contained in the reaction vessel was heated at 190° C. for 6 hours with a heating mantle equipped with a magnetic stirrer to generate nickel powders. The resulting nickel powders were filtered to separate, and then washed with distilled water. The resulting nickel powders were dried at 25° C. for 8 hours in a vacuum oven.

Figure 6:
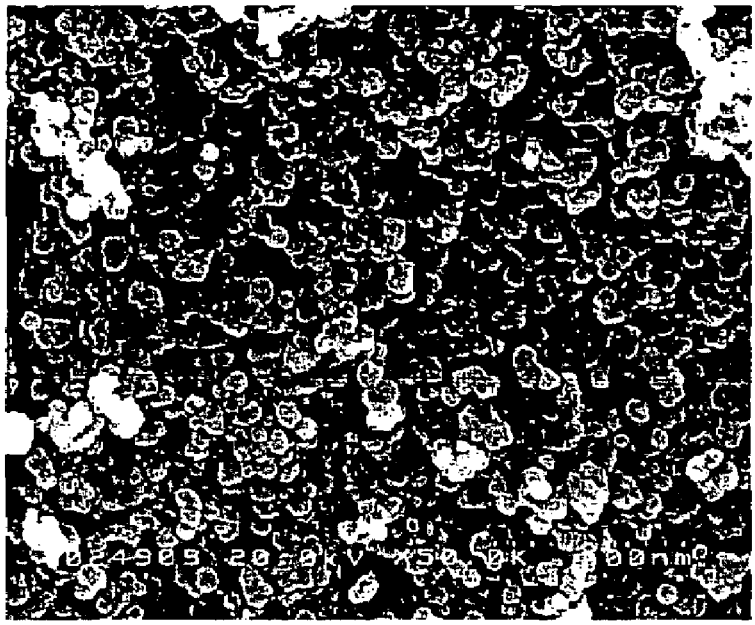
FIG. 6 is a SEM photograph of the nickel powders prepared according to Comparative example 1.

The SEM photograph for the nickel powders of Comparative example 1 was photographed, and the photograph is shown in FIG. 6. As shown in FIG. 6, the shape of the nickel powders of Comparative example 1 was sphere and their particle size is about 90 nm. About 4.7 g of the powders were obtained.

Comparative Example 2

TMAH 23 g of TMAH were dissolved in 250 ml of diethylene glycol to prepare the first solution. 30 g of $Ni(CH_3COO)_2.4H_2O$ were dissolved in 250 ml of diethylene glycol to prepare the second solution. 0.0996 g of $K_2PtCl_4$ nucleating agent were dissolved in 2 ml of ethylene glycol to prepare the third solution. The first solution, the second solution and the third solution were placed into a reaction vessel and stirred.

The mixture contained in the reaction vessel was heated at 200° C. for 6 hours with a heating mantle equipped with a magnetic stirrer to generate nickel powders. The resulting nickel powders were filtered to separate, and then washed with distilled water. The resulting nickel powders were dried at 25° C. for 8 hours in a vacuum oven.

Figure 7:
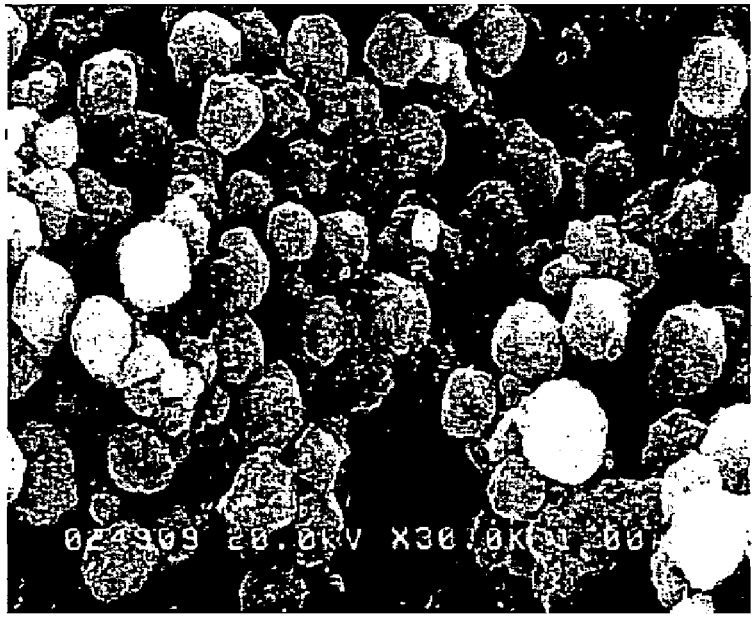
FIG. 7 is a SEM photograph of the nickel powders prepared according to Comparative example 2.

The SEM photograph for the nickel powders of Comparative example 2 was photographed, and the photograph is shown in FIG. 7. As shown in FIG. 7, the shape of the nickel powders of Comparative example 2 was sphere and their particle size is about 270 nm. About 7 g of the powders were obtained.

Comparative Example 3

NaOH 10 g of NaOH inorganic base were dissolved in 250 ml of ethylene glycol to prepare the first solution. 20 g of $Ni(CH_3COO)_2.4H_2O$ were dissolved in 250 ml of ethylene glycol to prepare the second solution. 0.0332 g of $K_2PtCl_4$ nucleating agent were dissolved in 2 ml of ethylene glycol to prepare the third solution. The first solution, the second solution and the third solution were placed into a reaction vessel and stirred.

The mixture contained in the reaction vessel was heated at 190° C. for 6 hours with a heating mantle equipped with a magnetic stirrer to generate nickel powders. The resulting nickel powders were filtered to separate, and then washed with distilled water. The resulting nickel powders were dried at 25° C. for 8 hours in a vacuum oven.

Figure 8:
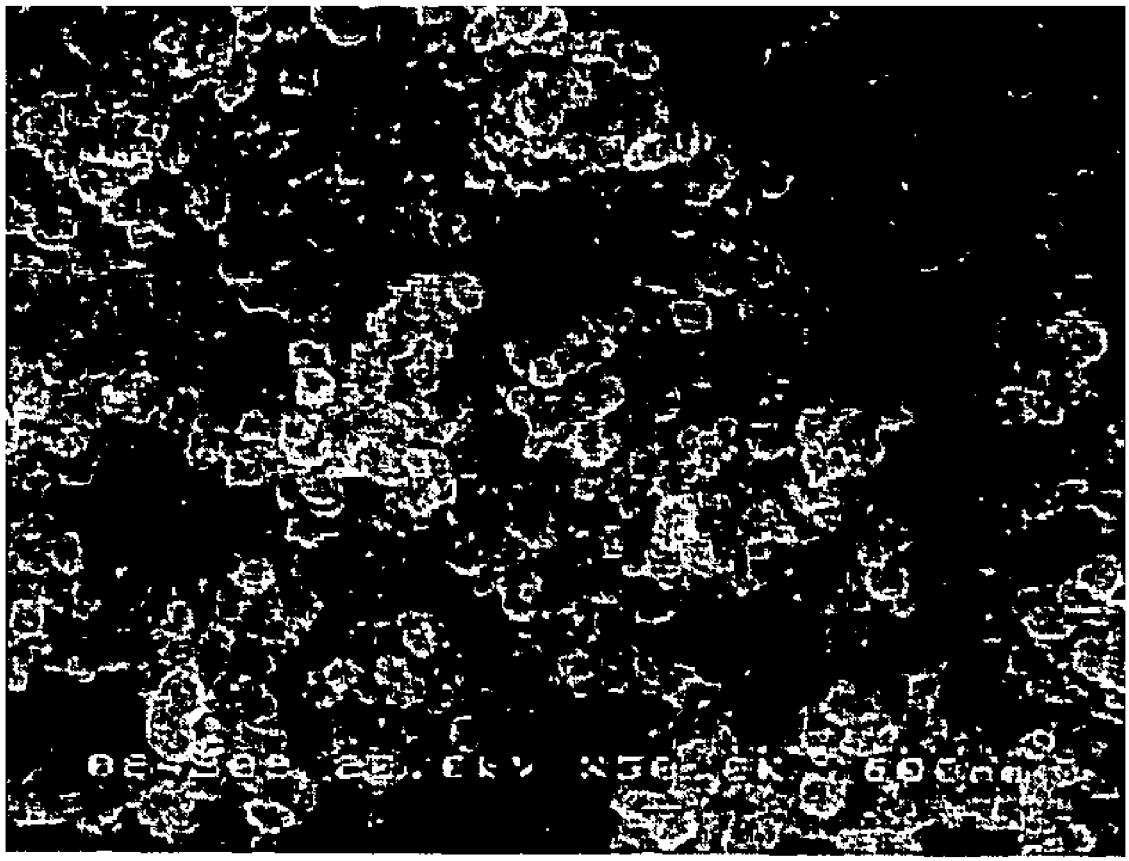
FIG. 8 is a SEM photograph of the nickel powders prepared according to Comparative example 3.

The SEM photograph for the nickel powders of Comparative example 3 was photographed, and the photograph is shown in FIG. 8. As shown in FIG. 8, the shape of the nickel powders of Comparative example 3 was sphere and their particle size is about 110 nm. About 4.7 g of the powders were obtained.

According to the method of preparing nickel powders of the present invention, the cost of preparing nickel powders can be reduced by using water instead of an expensive polyol as a solvent for a base.

That is, when the polyol that was used as a solvent for a base in the past is further added as a solvent for a nickel compound, the nickel compound can be further dissolved and the production of nickel powders can be increased.

Further, the amount of the nucleating agent introduced into the mixture can be reduced by comprising water as a solvent for a base in the mixture. Accordingly, the cost of preparing nickel powders can be reduced by decreasing the amount of the expensive nucleating agent.

Further, according to the preparation method of present invention, water in the mixture influences to the growth rate of the nickel particles in the reduction reaction, and acts as a reaction controller making the size of the nickel particles minute. Thus, the nickel powders prepared according to the present invention have minute and uniform particle sizes.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of preparing nickel powders characterized in that the method comprises preparing a first solution consisting of water and a base wherein the base is at least one of the following selected from the group consisting of sodium hydroxide, potassium hydroxide, tetramethylammonium hydroxide, tetraethylammonium hydroxide, tetrabutylammonium hydroxide, tetrapropylammonium hydroxide, benzyltrimethylammonium hydroxide, dimethyldiethylammonium hydroxide, ethyltrimethylammonium hydroxide, tetrabutyl phosphonium hydroxide, trimethylamine, diethylamine, and ethanolamine with said base being dissolved in said water, preparing a second solution formed by mixing a polyol and a nickel compound, preparing a mixture by mixing the first solution and the second solution wherein the amount of water in the mixture is about 0.025 to about 2 times the amount of polyol in the mixture, heating the mixture with the nickel compound being reduced to nickel metal in the form of a nickel powder and the water being removed by evaporation, and separating the nickel powders generated during heating.

2. A method of preparing nickel powders of claim 1, wherein the amount of water in the mixture is about 0.025 to about 0.5 times the amount of the polyol in the mixture.

3. A method of preparing nickel powders of claim 1, wherein the base is an inorganic base and is at least one of the following selected from the group consisting of sodium hydroxide and potassium hydroxide.

4. A method of preparing nickel powders of claim 1, wherein the base is an organic base and is at least one selected from the group consisting of tetramethylammonium hydroxide, tetraethylammonium hydroxide, tetrabutylammonium hydroxide, tetrapropylammonium hydroxide, benzyltrimethylammonium hydroxide, dimethyldiethylammonium hydroxide, ethyltrimethylammonium hydroxide, tetrabutyl phosphonium hydroxide, trimethylamine, diethylamine, and ethanolamine.

5. A method of preparing nickel powders of claim 1, wherein the water is distilled water.

6. A method of preparing nickel powders of claim 1, wherein the nickel compound is at least one of the following selected from the group consisting of nickel sulfate, nickel nitrate, nickel chloride, nickel bromide, nickel fluoride, nickel acetate, nickel acetylacetonate, and nickel hydroxide.

7. A method of preparing nickel powders of claim 1, wherein a nucleating agent is further mixed with the mixture of the first and second solutions.

8. A method of preparing nickel powders of claim 7, wherein the nucleating agent is at least one of the following selected from the group consisting of $K_2PtCl_4$, $H_2PtCl_6$, $PdCl_2$ and $AgNO_3$.

9. A method of preparing nickel powders of claim 1, wherein a third solution prepared by mixing a nucleating agent and water is further mixed with the mixture of the first and second solutions.

10. A method of preparing nickel powders of claim 1, wherein a third solution prepared by mixing a nucleating agent and a polyol is further mixed with the mixture of the first and second solutions.

11. A method of preparing nickel powders of claim 1, wherein a third solution prepared by mixing a nucleating agent, water and a polyol is further mixed with the mixture of the first and second solutions.

12. A method of preparing nickel powders of claim 1, wherein heating the mixture comprises a first heating in which the mixture is heated at about 25° to about 160°, and a second heating in which the mixture is heated at about 160° to 350° after the first heating.

13. A method of preparing nickel powders of claim 12, wherein the first heating is performed for about 0.5 to about 4 hours, and the second heating is performed for about 2 to about 20 hours.

* * * * *